US009377262B2

(12) United States Patent
Curry

(10) Patent No.: US 9,377,262 B2
(45) Date of Patent: Jun. 28, 2016

(54) BARREL WITH CAM FOLLOWERS

(71) Applicant: Smith & Wesson Corp., Springfield, MA (US)

(72) Inventor: Brett Curry, Monson, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 14/543,926

(22) Filed: Nov. 18, 2014

(65) Prior Publication Data

US 2016/0138882 A1 May 19, 2016

(51) Int. Cl.
*F41A 21/00* (2006.01)
*F41A 5/04* (2006.01)
*F41A 5/14* (2006.01)

(52) U.S. Cl.
CPC . *F41A 21/00* (2013.01); *F41A 5/04* (2013.01); *F41A 5/14* (2013.01)

(58) Field of Classification Search
CPC ..... F41A 5/04; F41A 5/02; F41A 5/14; F41A 21/00
USPC ..... 89/163, 166, 167, 168
See application file for complete search history.

(56) References Cited

U.S. PATENT DOCUMENTS 3,158,064 A 11/1964 Charron
3,411,406 A 11/1968 Pachmayr et al.
3,411,408 A 11/1968 Pachmayr et al.
3,756,121 A 9/1973 Roy
4,275,640 A 6/1981 Wilhelm
5,502,989 A 4/1996 Murray, Jr. et al.
6,318,231 B1 * 11/2001 Kart ..... F41A 25/22 89/163
6,442,882 B1 9/2002 Dionne
8,333,142 B1 12/2012 Karfiol et al.
8,453,555 B1 * 6/2013 Karfiol ..... F41A 3/14 89/163
8,621,976 B1 1/2014 Karfiol et al.
2010/0154273 A1 * 6/2010 Lippard ..... F41A 21/488 42/75.02

FOREIGN PATENT DOCUMENTS

CA 2290025 * 5/2001

* cited by examiner

*Primary Examiner* — Stephen M Johnson

(74) *Attorney, Agent, or Firm* — John A. Chionchio, Esq.; Ballard Spahr LLP

(57) ABSTRACT

A barrel for a semiautomatic firearm operating under the short recoil system has one or more cam followers projecting outwardly to engage one or more cams positioned on an inner surface of a slide surrounding the barrel. Interaction between the cams and the cam followers controls the angle between the longitudinal axis of the barrel and the axis of motion of the slide to prevent the breech end of the barrel from moving too far as the barrel tilts as it unlocks from the slide, ensuring that the extractor will engage the rim of a spent casing and extract it from the chamber during recoil.

45 Claims, 6 Drawing Sheets

BARREL WITH CAM FOLLOWERS

FIELD OF THE INVENTION

This invention relates to barrels for firearms.

BACKGROUND

During operation of semiautomatic pistols using the short recoil system, the breech end of the barrel drops downwardly toward the frame after the barrel unlocks from the slide as the slide and barrel move relatively to the frame in recoil as a round is fired. This drop of the barrel's breech end causes the longitudinal axis of the barrel to have an angular orientation with respect to the direction of motion of the slide. The drop of the breech end also causes the now spent cartridge casing in the chamber to move downwardly relatively to the slide, on which the extractor is mounted. Under certain conditions the drop could be great enough to allow the rim of the spent casing to drop below the controlling surface of the extractor, causing a failure to extract as the barrel's breech end separates from the breech block mounted on the slide. This type of malfunction is particularly difficult to clear. There is an opportunity therefore, to increase the reliability of semiautomatic pistols operating on the short recoil system by controlling the breech end drop of the barrel, or the angular orientation of the barrel's longitudinal axis with respect to the direction of motion of the slide.

SUMMARY

The invention concerns a barrel for a firearm. In one example embodiment, the barrel comprises a tube having a breech end and a muzzle end oppositely disposed. The tube defines a longitudinal axis extending lengthwise along and positioned coaxially within the tube. A chamber comprises the breech end of the tube and an arresting means underlies the chamber. A first cam follower is positioned on the tube between the breech end and the muzzle end. The first cam follower comprises a projection extending outwardly from the tube in a direction angularly offset about the longitudinal axis from the arresting means.

In a particular example, the first cam follower is offset about the longitudinal axis about 180° from the arresting means. Further by way of example, the first cam follower comprises a first surface of the projection oriented angularly with respect to the longitudinal axis, the first surface facing the muzzle end. In a specific example, the first surface has an orientation angle from about 10° to about 20° relative to the longitudinal axis. In a particular example, the first surface has an orientation angle of about 15° relative to the longitudinal axis.

In another example embodiment, the first cam follower further comprises a second surface of the projection contiguous with the first surface and positioned between the first surface and the breech end. In this example the second surface is substantially parallel to the longitudinal axis.

By way of further example, the first cam follower comprises a surface of the projection oriented substantially parallel to the longitudinal axis. Another example embodiment further comprises a second cam follower positioned on the tube and underlying the muzzle end. The second cam follower comprises a projection extending outwardly from the tube by way of example.

In an example embodiment, the second cam follower is substantially aligned with the arresting means lengthwise along the tube. Further to an example, the second cam follower comprises a first surface of the projection oriented angularly relative to the longitudinal axis, the first surface facing the breech end. In a particular example the first surface has an orientation angle from about 5° to about 15° relative to the longitudinal axis. In a specific example, the first surface has an orientation angle of about 10° relative to the longitudinal axis.

By way of further example, the second cam follower further comprises a second surface of the projection contiguous with the first surface and positioned between the first surface and the muzzle end. In a specific example, the second surface is oriented substantially parallel to the longitudinal axis.

Specifically, by way of example, the arresting means comprises a locking cam, or the arresting means comprises a pivoting link.

The invention also encompasses a firearm. By way of example, the firearm comprises a frame, a slide mounted on the frame and reciprocably movable relative thereto along a slide axis, the slide having an inner surface defining a central space. In this example a first is cam positioned on the inner surface of the slide. A barrel is mounted on the frame and positioned within the central space. In this example the barrel comprises a tube having a breech end and a muzzle end oppositely disposed. The tube defines a longitudinal axis extending lengthwise along and positioned coaxially within the tube in this example. Further by way of example, a chamber comprising the breech end of the tube and an arresting means underlies the chamber. A first cam follower is positioned on the tube between the breech end and the muzzle end in this example. The first cam follower comprises a projection extending outwardly from the tube in a direction angularly offset from the arresting means about the longitudinal axis so as to align with the first cam. In this example the first cam follower engages the first cam upon sliding motion of the slide relatively to the barrel. Engagement between the first cam follower and the first cam determines an orientation angle between the longitudinal axis of the barrel and the slide axis during operation of the firearm.

In this example embodiment the first cam comprises a recess in the inner surface of the slide. The recess has a ramp surface oriented angularly with respect to the slide axis. The ramp surface faces the first cam follower. Further in this example, a run surface is on the inner surface of the slide. The run surface is contiguous with the ramp surface and positioned between the recess and the muzzle end.

In a particular example, the run surface is oriented substantially parallel to the slide axis. In a specific example, the ramp surface has an orientation angle relative to the slide axis from about 10° to about 20°. Particularly by way of example, the ramp surface has an orientation angle of about 15° relative to the slide axis.

By way of further example, the first cam comprises a recess in the inner surface of the slide and a run surface on the inner surface of the slide. In this example the run surface is positioned between the recess and the muzzle end. By way of further example the run surface is oriented substantially parallel to the slide axis. In a particular example embodiment the first cam follower is offset about the longitudinal axis about 180° from the arresting means. By way of example, the first cam follower comprises a first surface of the projection oriented angularly with respect to the longitudinal axis, the first surface facing the muzzle end. In a particular example, the first surface has an orientation angle from about 10° to about 20° relative to the longitudinal axis. By way of a specific example embodiment, the first surface has an orientation angle of about 15° relative to the longitudinal axis.

By way of example, the first cam follower further comprises a second surface of the projection contiguous with the first surface and positioned between the first surface and the breech end, the second surface being substantially parallel to the longitudinal axis. In an example embodiment the first cam follower comprises a surface of the projection oriented substantially parallel to the longitudinal axis. Generally by way of example, the orientation angle between the longitudinal axis of the barrel and the slide axis does not exceed 2° during operation of the firearm.

Another example embodiment further comprises a second cam mounted on the inner surface of the slide, the second cam being positioned proximate to the muzzle end of the tube. In this example a second cam follower is positioned on the tube and underlies the muzzle end. The second cam follower comprises a projection extending outwardly from the tube and aligned with the second cam. In this example, upon motion of the slide relative to the barrel, the second cam follower engages the second cam. The first and second cams and cam followers cooperate in this example to determine the orientation angle between the longitudinal axis of the barrel and the slide axis during operation of the firearm.

By way of example the second cam comprises a surface oriented substantially parallel to the slide axis. Further by example, the second cam follower is substantially aligned with the arresting means. In another example, the second cam follower comprises a first surface of the projection oriented angularly relative to the longitudinal axis, the first surface facing the breech end. In a specific example the first surface has an orientation angle from about 5° to about 15° relative to the longitudinal axis. Particularly by way of example, the first surface has an orientation angle of about 10° relative to the longitudinal axis.

In another example embodiment the second cam follower further comprises a second surface of the projection contiguous with the first surface and positioned between the first surface and the muzzle end, the second surface being substantially parallel to the longitudinal axis. In a specific example the arresting means comprises a locking cam or a pivoting link.

DETAILED DESCRIPTION

Figure 1:
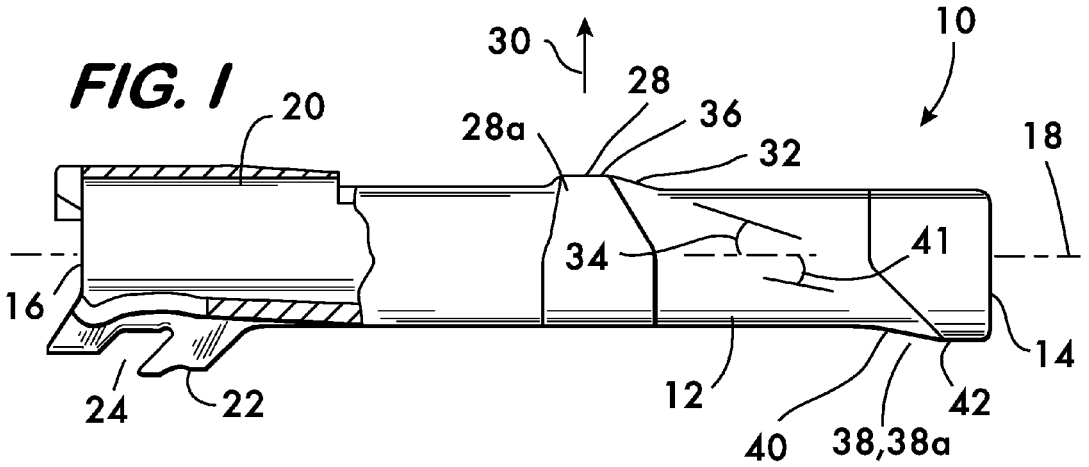
FIGS. 1, 1A and 1B are side views of example embodiments of barrels according to the invention.
Figure 1A:
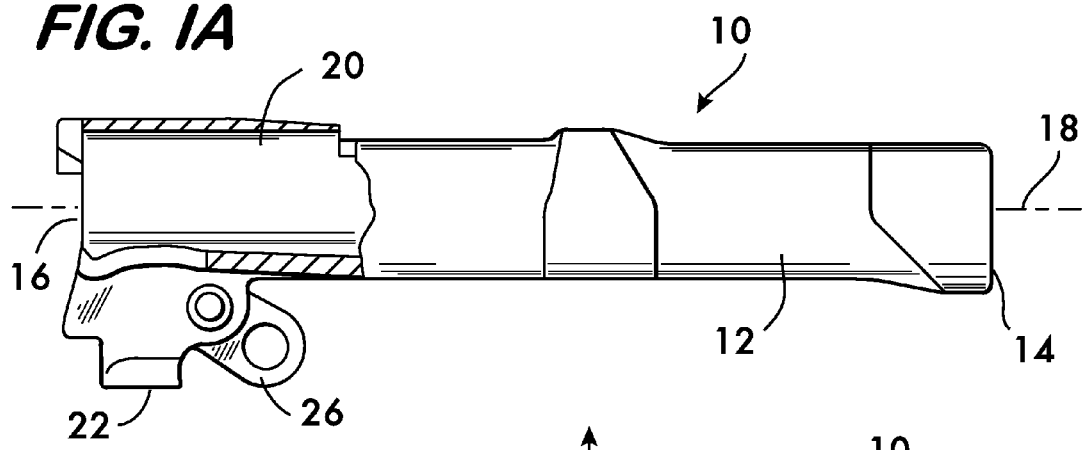

FIG. 1 shows a barrel 10 for a semiautomatic pistol using the short recoil operating system. Barrel 10 comprises a tube 12 having a muzzle end 14 oppositely disposed from a breech end 16. Tube 12 defines a longitudinal axis 18 positioned coaxially within the tube and extending lengthwise thereal-ong. A chamber 20 comprises the breech end of the tube 12, the chamber receiving a cartridge (not shown) during operation of the pistol. An arresting means 22 underlies the chamber 20. Arresting means 22 serves to arrest motion of the barrel 10 during short recoil operation (described below) so that the barrel separates from the breech block at the appropriate time after a round has been fired to permit extraction of the spent cartridge casing and chambering of the next round. In this example, arresting means 22 comprises a locking cam 24. Other example arresting means include the pivoting link 26, shown in FIG. 1A.

Figure 1B:
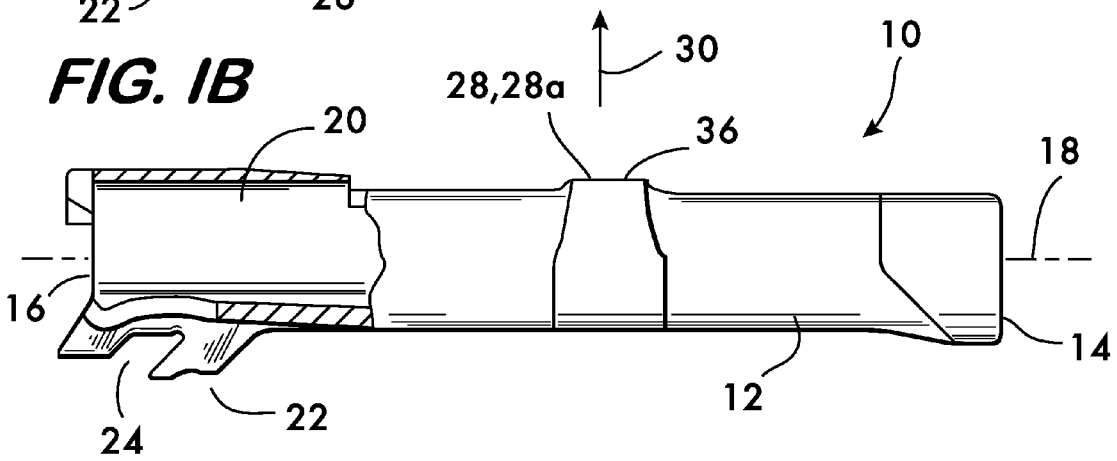

A first cam follower 28 is positioned on tube 12 between the breech end 16 and the muzzle end 14. Cam follower 28 comprises a projection 28*a* extending outwardly from tube 12 in a direction indicated by arrow 30 that is angularly offset about the longitudinal axis 18 from arresting means 22. In this example the cam follower 28 is offset 180° from the arresting means 22, i.e., the projection direction 30 is angularly opposite to the arresting means 22. First cam follower 28 comprises a first surface 32 of the projection 28*a*facing the muzzle end 14 of barrel 10 and oriented angularly with respect to the longitudinal axis 18. Orientation angles 34 from about 10° about 20° are feasible, with an orientation angle of 15° being advantageous. The first cam follower 28 further comprises a second surface 36, contiguous with the first surface 32, the second surface 36 being oriented substantially parallel with longitudinal axis 18 and positioned between the first surface 32 and the breech end 16 of barrel 10. While it is advantageous for the first cam follower 28 to include angularly oriented surface 32, it is also feasible to dispense with this surface so that the first cam follower comprises only the second surface 36 oriented substantially parallel to longitudinal axis 18 as shown in FIG. 1B.

Barrel 10 may further include a second cam follower 38 positioned underlying the muzzle end 14 of tube 12. Second cam follower 38 is substantially aligned with arresting means 22 lengthwise along tube 12 and comprises a projection 38*a*extending outwardly therefrom. In this example the second cam follower 38 comprises a first surface 40 of the projection facing the breech end 16 of tube 12 and oriented angularly with respect to the tube's longitudinal axis 18. Orientation angles 41 from about 5° to about 15° are feasible, with an orientation angle of 10° being advantageous. The second cam follower 38 further comprises a second surface 42 of the projection 38*a*, contiguous with the first surface 40, the second surface 42 being oriented substantially parallel with longitudinal axis 18 and positioned between the first surface 40 and the muzzle end 14 of barrel 10.

Figure 2:
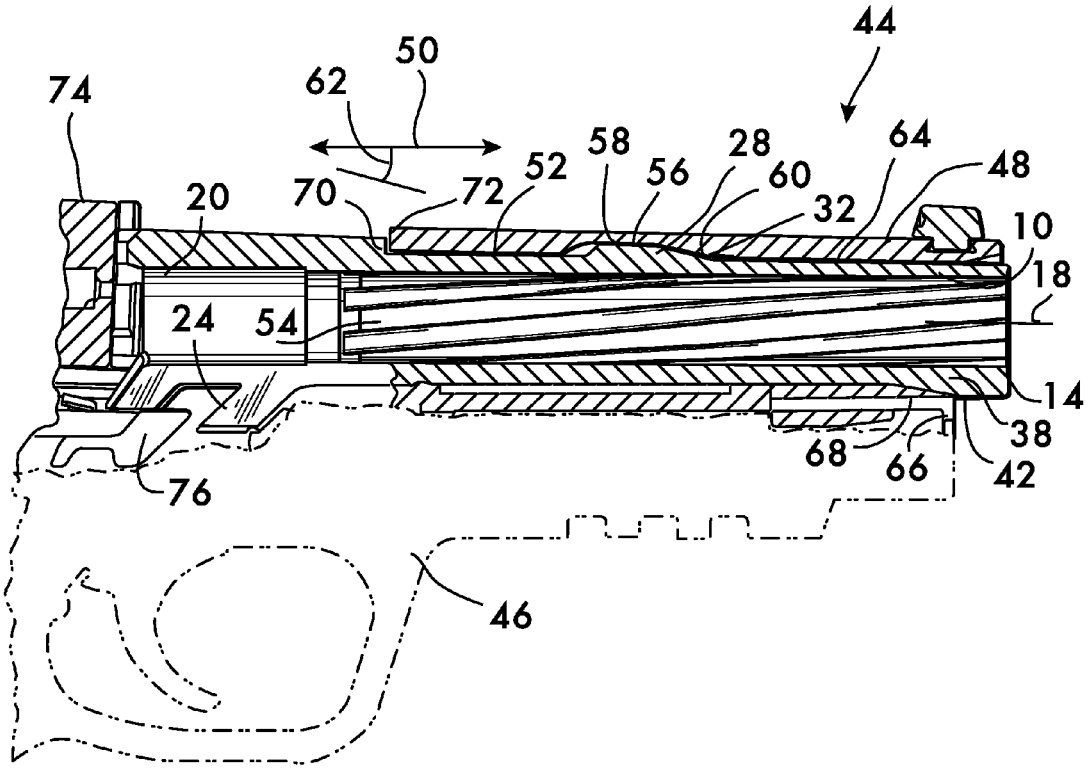
FIGS. 2, 2A and 2B are partial longitudinal sectional views of an example embodiment of semiautomatic pistol according to the invention in battery.

FIG. 2 shows a firearm, in this example, a semiautomatic pistol 44 comprising a frame 46 on which a slide 48 is mounted. Slide 48 is reciprocably movable relative to the frame 46 along a slide axis indicated by arrow 50. Slide 48 has an inner surface 52 that defines a central space 54. Barrel 10 is also mounted on frame 46 and positioned within the central space 54 defined by the slide 48. A first cam 56 is positioned on the inner surface 52 of slide 48. In this example the first cam 56 comprises a recess 58 in the inner surface 52. Recess 58 has a ramp surface 60 oriented angularly with respect to the slide axis 50. Orientation angles 62 from about 10° to about 20° are feasible, with an orientation angle of 15° being advantageous. Slide 48 and barrel 10 are arranged such that ramp surface 60 faces the first cam follower 28 on the barrel. Ramp surface 60 is contiguous with a run surface 64 which is also part of the first cam 56 and extends lengthwise along the inner surface 52 of slide 48.

Pistol 44 may also comprise a second cam 66 mounted on the inner surface 52 of slide 48 and positioned proximate to the muzzle end 14 of barrel 10 for engagement with the second cam follower 38 during operation of the pistol 44. In this example the second cam 66 comprises a surface 68 oriented substantially parallel to the slide axis 50. Second cam 66 is aligned with the second cam follower 38 to permit the two cams and cam followers to cooperate with one another and control the angle between the longitudinal axis 18 of barrel 10 and the slide axis 50 during operation of the pistol 44.

FIGS. 2 through 5 illustrate operation of pistol 44 under the short recoil system and employing the first and second cams 56 and 66 and their respective first and second cam followers 28 and 38. FIG. 2 shows the pistol 44 just before a cartridge (not shown) is fired. Barrel 10 is "in battery", the barrel being locked to the slide 48 via contact between a locking lug 70 on barrel 10 and a locking surface 72 on the slide 48. Chamber 20 is closed by breech block 74, affixed to the slide 48 and thereby also locked to the barrel 10. The first cam follower 28 resides within the recess 58, the first surface 32 of the first cam follower and the ramp surface 60 of the first cam 56 being in facing relation. The second surface 42 of the second cam follower 38 is engaged with the surface 68 of the second cam 66, supporting the muzzle end 14 of the barrel 10. Locking cam 24 underlying the chamber 20 is aligned and in spaced relation to a stop block 76, which is fixed to the frame 46.

Figure 3:
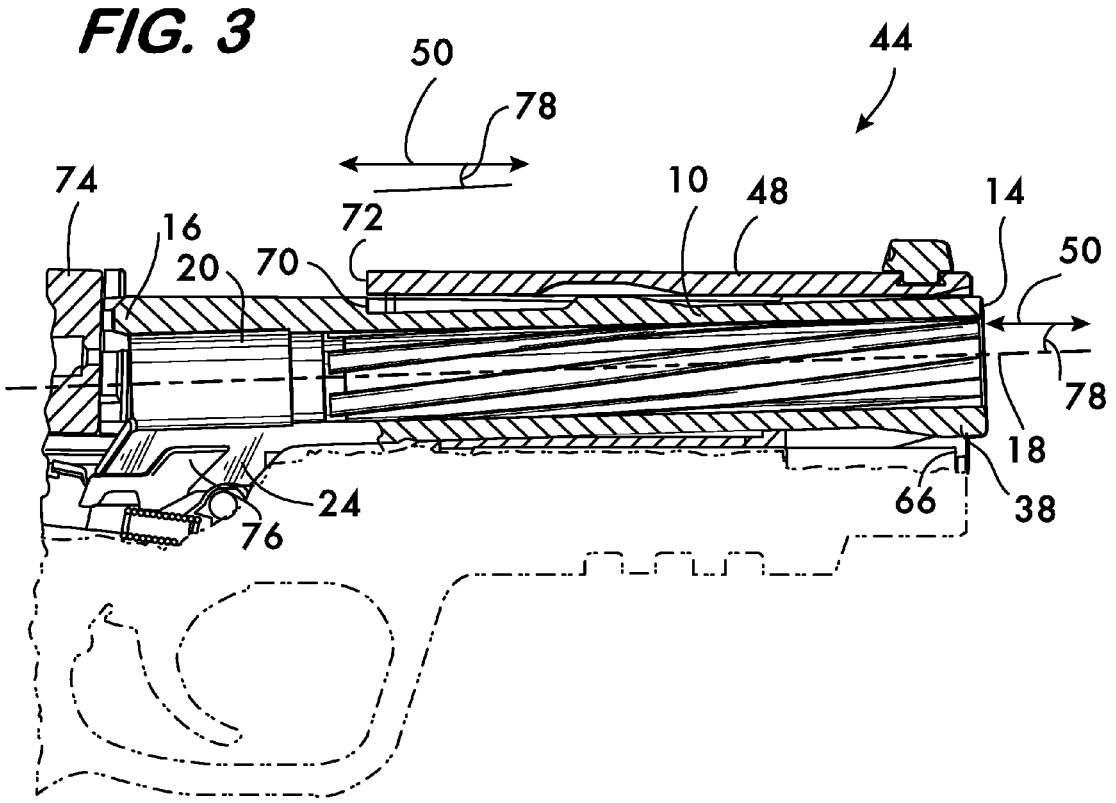
FIG. 3 is a partial longitudinal sectional view of the pistol shown in FIG. 2, at the moment of unlock between the barrel and slide.

FIG. 3 shows the pistol 44 during discharge of the cartridge (not shown). The slide 48 and barrel 10 have moved back together along the slide axis 50 out of battery in recoil, the breech block 74 sealing the chamber 20 long enough to impart energy to the projectile of the cartridge and permit the gas pressure within the barrel 10 to drop to a safe level. Barrel 10 and slide 48 are shown at the moment when the locking lug 70 on the barrel 10 falls off of the locking surface 72 of slide 48, unlocking the barrel from the slide and thereby also from the breech block 74. Unlocking of the barrel 10 from the slide 48 is effected by interaction between the locking cam 24 and the stop block 76, which draws the breech end 16 of the barrel 10 downwardly toward the frame 46 due to the angled geometry of the contacting surfaces of the locking cam and the stop block as the locking cam 24 moves into engagement with the stop block 76. The interaction tilts the barrel 10 relative to the slide 48, as illustrated by the orientation angle 78 between the longitudinal axis 18 of the barrel 10 and the slide axis 50. Muzzle end 14 of barrel 10 is supported on the second cam 66 through contact with the second cam follower 38.

Figure 4:
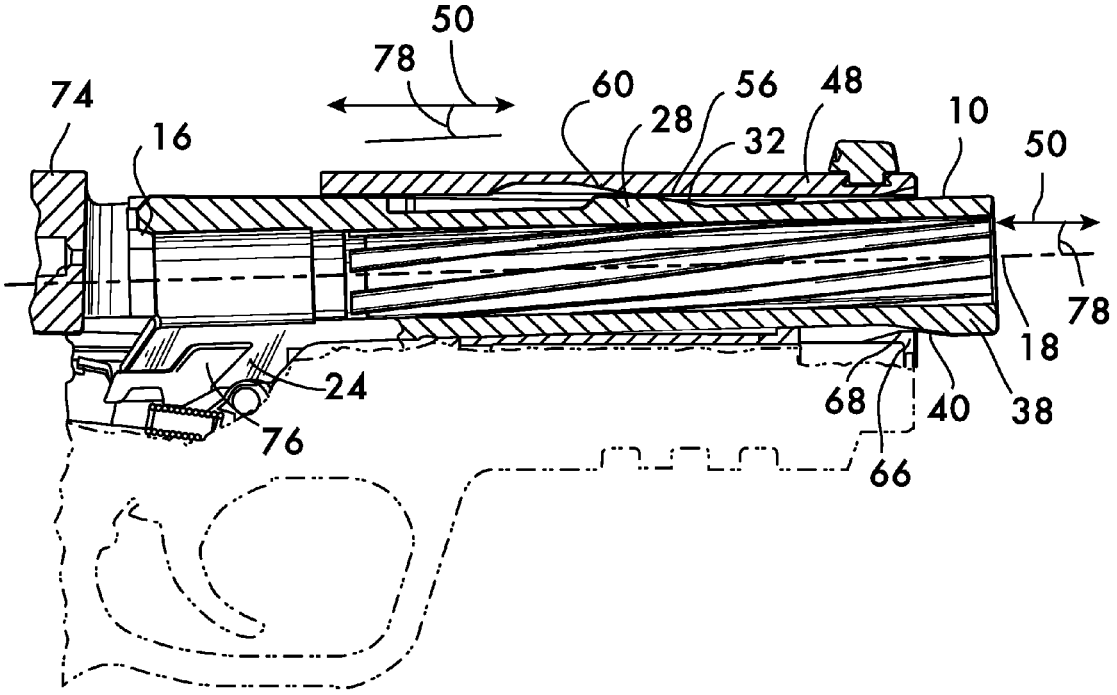
FIG. 4 is a partial longitudinal sectional view of the pistol shown in FIG. 2, at a point during short recoil operation.

As shown in FIG. 4, engagement between the locking cam 24 and the stop block 76 arrests recoil motion of barrel 10. However, since the barrel 10 and slide 48 are no longer locked together the slide continues to recoil inertially against its return spring (not shown). Breech block 74 separates from the breech end 16 of the barrel 10 and the first cam 56 moves relative to the first cam follower 28 such that the first surface 32 of the first cam follower rides along the ramp surface 60 of the first cam. Substantially contemporaneously, the first surface 40 of the second cam follower 38 engages the surface 68 of the second cam 66. Together, the cooperation of the first and second cams 56 and 66 and respective first and second cam followers 28 and 38 control the tilt of barrel 10 as measured by the orientation angle 78 between the longitudinal axis 18 of the barrel 10 and the slide axis 50.

Figure 5:
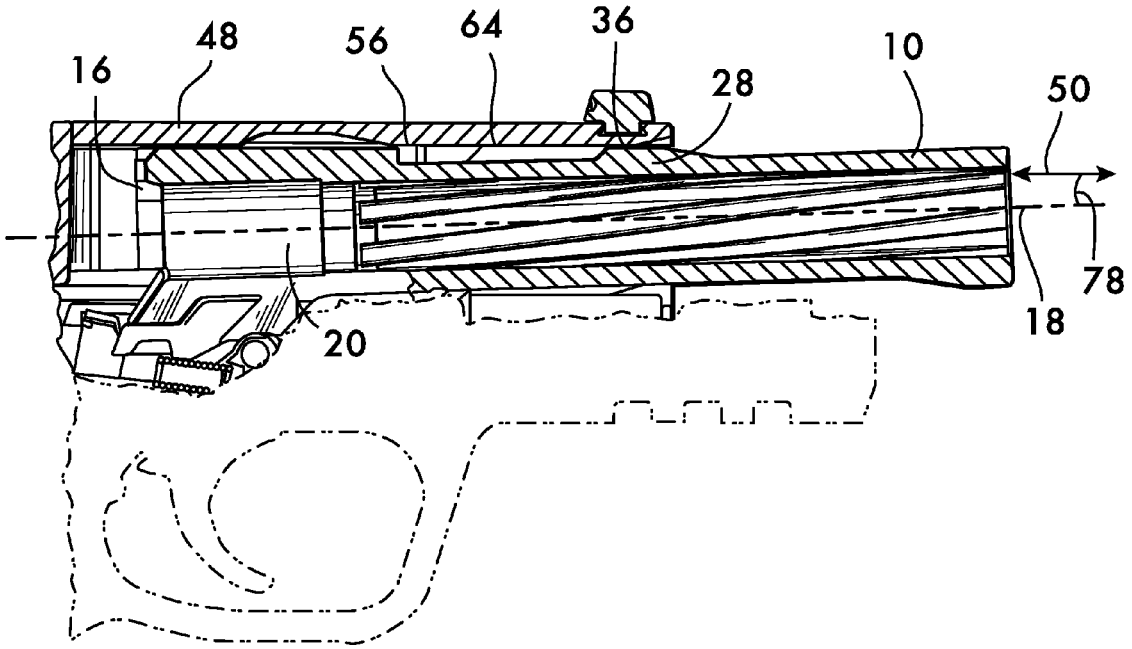
FIG. 5 is a partial longitudinal sectional view of the pistol shown in FIG. 2, at the point of maximum slide recoil.

FIG. 5 shows the slide 48 fully recoiled along slide axis 50, just before it reverses direction under the influence of its return spring (not shown) to strip the next cartridge from the magazine, chamber the cartridge, and move the barrel 10 back into battery. As the slide 48 moves back in recoil the second surface 36 of the first cam follower 28 rides along the run surface 64 of first cam 56. Contact between second surface 36 and the run surface 64 establishes the desired orientation angle 78 between the barrel longitudinal axis 18 and the slide axis 50. It is advantageous to control this orientation angle 78 to provide: 1) a shallower, controlled angle at the point in the firing cycle where the round being chambered engages the feed ramp (not shown) to ensure reliable feeding; and 2) to prevent the breech end 16 of the barrel 10 from moving too far downwardly away from the slide 48 as barrel 10 tilts to ensure reliable extraction. If the orientation angle 78 is not controlled then there is an increased chance of a misfeed of the round being chambered as well as the chance that the breech end 16 will move too far when barrel 10 tilts and thereby permit the rim of the spent cartridge casing in chamber 20 to drop below the controlling surface of the extractor (not shown), resulting in a failure to extract the spent casing and an ensuing malfunction of the pistol as the slide 48, on return to battery, tries to move a live cartridge from the magazine and into a chamber that is still occupied by the spent casing.

In a specific example firearm having a barrel with cams as disclosed herein, wherein the orientation angle 34 of the first surface 32 of the cam follower (or the orientation angle 62 of the ramp surface 60) is about 15°, it is expected that the angle 78 between the barrel longitudinal axis 18 and the slide axis 50 will be reduced from 2.45° to 1.47° at the point in the operation cycle where a round is being chambered, and, at the point in the operation cycle where a round is being ejected, the angle 78 is expected to be reduced from 2.47° to 1.12°. While the desired orientation angle 78 will vary depending upon the particular firearm, it is expected that orientation angles no greater than 2° will be advantageous for many applications.

Figure 2A:
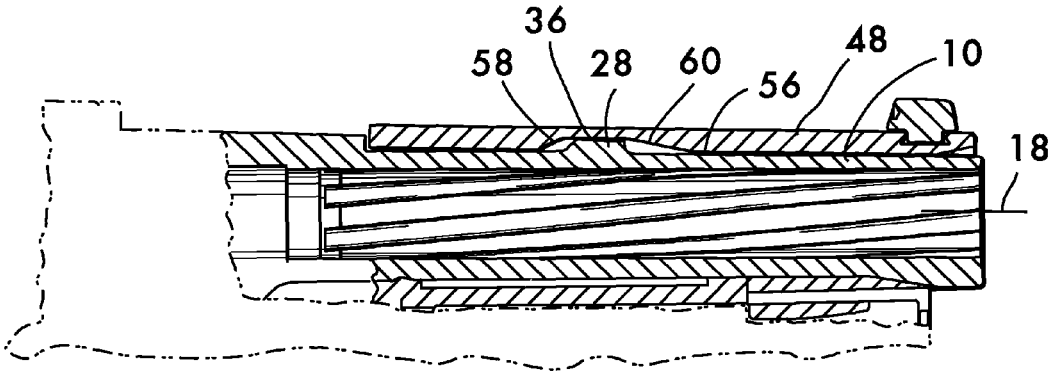
Figure 2B:
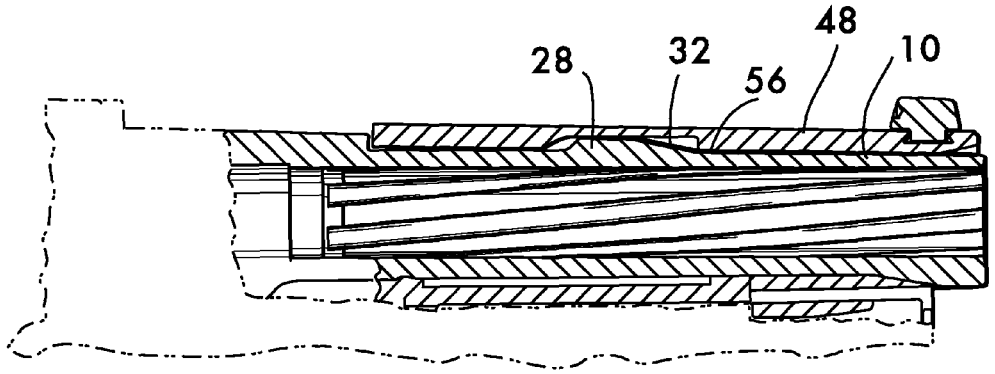

Additional practical embodiments of the barrel 10 and slide 48 are shown in FIGS. 2A and 2B. In FIG. 2A, the first cam follower 28 has only surface 36, oriented substantially parallel to longitudinal axis 18 (see also FIG. 1B). In this embodiment the angularly oriented ramp surface 60 of the first cam 56 is present in the recess 58 to permit smooth engagement between cam and cam follower during cycling of the slide 48. In FIG. 2B, the cam 56 dispenses with the ramp surface, the cam follower 28 on barrel 10 having the angularly oriented surface 32 to ensure smooth cam and cam follower engagement during cycling of the slide 48.

Using cam followers on the barrel and cams on the slide to control the angle of orientation of the barrel during operation it is expected that pistols operating on the short recoil system will operate with greater reliability. In particular, smaller barrel orientation angles are expected to be advantageous with respect to ammunition feeding.

What is claimed is:

1. A barrel for a firearm, said barrel comprising:

a tube having a breech end and a muzzle end oppositely disposed, said tube defining a longitudinal axis extending lengthwise along and positioned coaxially within said tube;

a chamber comprising said breech end of said tube;

a means for arresting motion of said barrel underlying said chamber;

a first cam follower positioned on said tube between said breech end and said muzzle end, said first cam follower comprising a projection extending outwardly from said tube in a direction angularly offset about said longitudinal axis from said means for arresting motion of said barrel, a first surface of said projection oriented angularly with respect to said longitudinal axis, said first surface facing said muzzle end and having an orientation angle from about 10° to about 20° relative to said longitudinal axis;

a second cam follower positioned on said tube and underlying said muzzle end, said second cam follower comprising a projection extending outwardly from said tube; wherein said first cam follower is positioned lengthwise between said second cam follower and said means for arresting motion of said barrel.

2. The barrel according to claim 1, wherein said first cam follower is offset about said longitudinal axis about 180° from said means for arresting motion of said barrel.

3. The barrel according to claim 1, wherein said first surface has an orientation angle of about 15° relative to said longitudinal axis.

4. The barrel according to claim 1, wherein said first cam follower further comprises a second surface of said projection contiguous with said first surface and positioned between said first surface and said breech end, said second surface being substantially parallel to said longitudinal axis.

5. The barrel according to claim 1, wherein said second cam follower is substantially aligned with said means for arresting motion of said barrel lengthwise along said tube.

6. The barrel according to claim 1, wherein said projection of said second cam follower comprises a first surface oriented angularly relative to said longitudinal axis, said first surface of said projection of said second cam follower facing said breech end.

7. The barrel according to claim 6, wherein said first surface of said projection of said second cam follower has an orientation angle from about 5° to about 15° relative to said longitudinal axis.

8. The barrel according to claim 6, wherein said first surface of said projection of said second cam follower has an orientation angle of about 10° relative to said longitudinal axis.

9. The barrel according to claim 6, wherein said second cam follower further comprises a second surface of said projection of said second cam follower contiguous with said first surface of said projection of said second cam follower and positioned between said first surface of said projection of said second cam follower and said muzzle end, said second surface of said projection of said second cam follower being oriented substantially parallel to said longitudinal axis.

10. The barrel according to claim 1, wherein said means for arresting motion of said barrel comprises a locking cam.

11. The barrel according to claim 1, wherein said means for arresting motion of said barrel comprises a pivoting link.

12. A firearm comprising:

a frame;

a slide mounted on said frame and reciprocably movable relative thereto along a slide axis, said slide having an inner surface defining a central space;

a first cam positioned on said inner surface of said slide, said first cam comprising a run surface on said inner surface of said slide and a recess in said inner surface of said slide, said recess having a ramp surface oriented angularly with respect to said slide axis, said run surface being contiguous with said ramp surface and positioned between said recess and said muzzle end;

a barrel mounted on said frame and positioned within said central space, said barrel comprising:

a tube having a breech end and a muzzle end oppositely disposed, said tube defining a longitudinal axis extending lengthwise along and positioned coaxially within said tube;

a chamber comprising said breech end of said tube;

a means for arresting motion of said barrel underlying said chamber;

a first cam follower positioned on said tube between said breech end and said muzzle end, said first cam follower comprising a projection extending outwardly from said tube in a direction angularly offset from said means for arresting motion of said barrel about said longitudinal axis so as to align with said first cam, said ramp surface facing said first cam follower and having an orientation angle relative to said slide axis from about 10° to about 20° ; wherein said first cam follower engages said first cam upon sliding motion of said slide relatively to said barrel;

a second cam mounted on said inner surface of said slide, said second cam being positioned proximate to said muzzle end of said tube;

a second cam follower positioned on said tube and underlying said muzzle end, said second cam follower comprising a projection extending outwardly from said tube and aligned with said second cam, said first cam follower being positioned lengthwise between said second cam follower and said means for arresting motion of said barrel; wherein upon motion of said slide relative to said barrel said second cam follower engages said second cam, said first and second cams and cam followers cooperating to determine said orientation angle between said longitudinal axis of said barrel and said slide axis during operation of said firearm.

13. The firearm according to claim 12, wherein said run surface is oriented substantially parallel to said slide axis.

14. The firearm according to claim 12, wherein said ramp surface has an orientation angle of about 15° relative to said slide axis.

15. The firearm according to claim 12, wherein said run surface is oriented substantially parallel to said slide axis.

16. The firearm according to claim 12, wherein said first cam follower is offset about said longitudinal axis about 180° from said means for arresting motion of said barrel.

17. The firearm according to claim 12, wherein said first cam follower comprises a first surface of said projection oriented angularly with respect to said longitudinal axis, said first surface facing said muzzle end.

18. The firearm according to claim 17, wherein said first surface has an orientation angle from about 10° to about 20° relative to said longitudinal axis.

19. The firearm according to claim 17, wherein said first surface has an orientation angle of about 15° relative to said longitudinal axis.

20. The firearm according to claim 17, wherein said first cam follower further comprises a second surface of said projection contiguous with said first surface and positioned between said first surface and said breech end, said second surface being substantially parallel to said longitudinal axis.

21. The firearm according to claim 12, wherein said first cam follower comprises a surface of said projection oriented substantially parallel to said longitudinal axis.

22. The firearm according to claim 12, wherein said orientation angle between said longitudinal axis of said barrel and said slide axis does not exceed 2° during operation of said firearm.

23. The firearm according to claim 12, wherein said second cam comprises a surface oriented substantially parallel to said slide axis.

24. The firearm according to claim 12, wherein said second cam follower is substantially aligned with said means for arresting motion of said barrel.

25. The firearm according to claim 12, wherein said second cam follower comprises a first surface of said projection of said second cam follower oriented angularly relative to said longitudinal axis, said first surface facing said breech end.

26. The firearm according to claim 25, wherein said first surface of said projection of said second cam follower has an orientation angle from about 5° to about 15° relative to said longitudinal axis.

27. The firearm according to claim 25, wherein said first surface of said projection of said second cam follower has an orientation angle of about 10° relative to said longitudinal axis.

28. The firearm according to claim 25, wherein said second cam follower further comprises a second surface of said projection of said second cam follower contiguous with said first surface of said projection of said second cam follower and positioned between said first surface of said projection of said second cam follower and said muzzle end, said second surface of said projection of said second cam follower being substantially parallel to said longitudinal axis.

29. The firearm according to claim 12, wherein said means for arresting motion of said barrel comprises a locking cam.

30. The firearm according to claim 12, wherein said means for arresting motion of said barrel comprises a pivoting link.

31. A barrel for a firearm, said barrel comprising:

a tube having a breech end and a muzzle end oppositely disposed, said tube defining a longitudinal axis extending lengthwise along and positioned coaxially within said tube;

a chamber comprising said breech end of said tube;

a means for arresting motion of said barrel underlying said chamber;

a first cam follower positioned on said tube between said breech end and said muzzle end, said first cam follower comprising a projection extending outwardly from said tube in a direction angularly offset about said longitudinal axis from said means for arresting motion of said barrel;

a second cam follower positioned on said tube and underlying said muzzle end, said second cam follower comprising a projection extending outwardly from said tube, a surface of said projection of said second cam follower oriented angularly relative to said longitudinal axis, said surface of said projection of said second cam follower facing said breech end and having an orientation angle from about 5° to about 15° relative to said longitudinal axis; wherein said first cam follower is positioned lengthwise between said second cam follower and said means for arresting motion of said barrel.

32. The barrel according to claim 31, wherein said surface of said projection of said second cam follower has an orientation angle of about 10° relative to said longitudinal axis.

33. The barrel according to claim 31, wherein a surface of said projection of said first cam follower is oriented angularly with respect to said longitudinal axis, said surface of said projection of said first cam follower facing said muzzle end.

34. The barrel according to claim 33, wherein said surface of said projection of said first cam follower has an orientation angle from about 10° to about 20° relative to said longitudinal axis.

35. The barrel according to claim 33, wherein said surface of said projection of said first cam follower has an orientation angle of about 15° relative to said longitudinal axis.

36. A firearm comprising:

a frame;

a slide mounted on said frame and reciprocably movable relative thereto along a slide axis, said slide having an inner surface defining a central space;

a first cam positioned on said inner surface of said slide;

a barrel mounted on said frame and positioned within said central space, said barrel comprising:

a tube having a breech end and a muzzle end oppositely disposed, said tube defining a longitudinal axis extending lengthwise along and positioned coaxially within said tube;

a chamber comprising said breech end of said tube;

a means for arresting motion of said barrel underlying said chamber;

a first cam follower positioned on said tube between said breech end and said muzzle end, said first cam follower comprising a projection extending outwardly from said tube in a direction angularly offset from said means for arresting motion of said barrel about said longitudinal axis so as to align with said first cam, a surface of said projection oriented angularly with respect to said longitudinal axis, said surface facing said muzzle end, said surface having an orientation angle from about 10° to about 20° relative to said longitudinal axis; wherein said first cam follower engages said first cam upon sliding motion of said slide relatively to said barrel;

a second cam mounted on said inner surface of said slide, said second cam being positioned proximate to said muzzle end of said tube;

a second cam follower positioned on said tube and underlying said muzzle end, said second cam follower comprising a projection extending outwardly from said tube and aligned with said second cam, said first cam follower being positioned lengthwise between said second cam follower and said means for arresting motion of said barrel; wherein upon motion of said slide relative to said barrel said second cam follower engages said second cam, said first and second cams and cam followers cooperating to determine said orientation angle between said longitudinal axis of said barrel and said slide axis during operation of said firearm.

37. The firearm according to claim 36, wherein said surface of said projection of said first cam follower has an orientation angle of about 15° relative to said longitudinal axis.

38. The firearm according to claim 36, wherein a surface of said projection of said second cam follower is oriented angularly relative to said longitudinal axis, said surface of said projection of said second cam follower facing said breech end.

39. The firearm according to claim 38, wherein said surface of said projection of said second cam follower has an orientation angle from about 5° to about 15° relative to said longitudinal axis.

40. The firearm according to claim 38, wherein said surface of said projection of said second cam follower has an orientation angle of about 10° relative to said longitudinal axis.

41. A firearm comprising:

a frame;

a slide mounted on said frame and reciprocably movable relative thereto along a slide axis, said slide having an inner surface defining a central space;

a first cam positioned on said inner surface of said slide;

a barrel mounted on said frame and positioned within said central space, said barrel comprising:

a tube having a breech end and a muzzle end oppositely disposed, said tube defining a longitudinal axis extending lengthwise along and positioned coaxially within said tube;

a chamber comprising said breech end of said tube;

a means for arresting motion of said barrel underlying said chamber;

a first cam follower positioned on said tube between said breech end and said muzzle end, said first cam follower comprising a projection extending outwardly from said tube in a direction angularly offset from said means for arresting motion of said barrel about said longitudinal axis so as to align with said first cam; wherein said first cam follower engages said first cam upon sliding motion of said slide relatively to said barrel;

a second cam mounted on said inner surface of said slide, said second cam being positioned proximate to said muzzle end of said tube;

a second cam follower positioned on said tube and underlying said muzzle end, said second cam follower comprising a projection extending outwardly from said tube and aligned with said second cam, a surface of said projection of said second cam follower oriented angularly relative to said longitudinal axis at an orientation angle from about 5° to about 15° relative to said longitudinal axis, said surface facing said breech end, said first cam follower being positioned lengthwise between said second cam follower and said means for arresting motion of said barrel; wherein upon motion of said slide relative to said barrel said second cam follower engages said second cam, said first and second cams and cam followers cooperating to determine said orientation angle between said longitudinal axis of said barrel and said slide axis during operation of said firearm.

42. The firearm according to claim 41, wherein said surface has an orientation angle of about 10° relative to said longitudinal axis.

43. The firearm according to claim 41, wherein a surface of said projection of said first cam follower is oriented angularly with respect to said longitudinal axis, said surface of said projection of said first cam follower facing said muzzle end.

44. The firearm according to claim 41, wherein said surface of said projection of said first cam follower has an orientation angle from about 10° to about 20° relative to said longitudinal axis.

45. The firearm according to claim 41, wherein said surface of said projection of said first cam follower has an orientation angle of about15° relative to said longitudinal axis.

* * * * *